US006007369A

United States Patent [19]

Kennedy et al.

[11] Patent Number: 6,007,369

[45] Date of Patent: Dec. 28, 1999

[54] WIRE RETENTION CONTACT IN AN ELECTRICAL CONNECTOR

[75] Inventors: Kevin Lloyd Kennedy, Hummelstown; Dennis Leroy Kemmick, Columbia; Darrell Lynn Wertz, York, all of Pa.

[73] Assignee: The Whitaker Corporation, Wilmington, Del.

[21] Appl. No.: 09/098,914

[22] Filed: Jun. 17, 1998

[51] Int. Cl.[6] ..... H01R 4/24

[52] U.S. Cl. ..... 439/441; 439/268

[58] Field of Search ..... 439/440, 441, 439/268, 439, 856, 857, 266

[56] References Cited

U.S. PATENT DOCUMENTS

| | | | |
|---|---|---|---|
| 4,437,721 | 3/1984 | Kollmann et al. | 339/97 |
| 4,636,026 | 1/1987 | Cooney et al. | 339/255 R |
| 4,645,278 | 2/1987 | Yevak, Jr. et al. | 339/17 T |
| 4,701,138 | 10/1987 | Key | 439/417 |
| 5,022,872 | 6/1991 | Shichida | 439/856 |
| 5,106,328 | 4/1992 | Prochaska et al. | 439/751 |
| 5,162,004 | 11/1992 | Kuzuno et al. | 439/856 |
| 5,365,660 | 11/1994 | Capper et al. | 29/884 |

OTHER PUBLICATIONS

Abstract and drawings for File No. 17063, Ser. No. 09/008, 175 filed Jan.16,1998.

*Primary Examiner*—Michael L. Gellner
*Assistant Examiner*—Antoine Ngandjui
*Attorney, Agent, or Firm*—Michael Aronoff

[57] ABSTRACT

An electrical connector (16) associated with a component (10) is arranged to releasably receive a conductor (22, 24) and electrically interconnect the conductor to the component. The connector (16) includes a contact member (48) having a shank (62), a pair of first and second opposed beams (64, 66) extending from opposite edges of the shank upwardly into mutual pressing engagement and terminating in outwardly formed flanges (70) that are angled away from each other and from the shank (62). Conductor gripping portions (90, 92) are formed in the two flanges (70). By deflecting the beams (64, 66) the gripping portions (90, 92) are movable to an open position for receiving the conductor therein and movable to a closed position for gripping and electrically contacting the conductor.

12 Claims, 7 Drawing Sheets

WIRE RETENTION CONTACT IN AN ELECTRICAL CONNECTOR

The present invention relates to electrical connectors for releasably attaching conductors to leads of acoustical speakers, and more particularly to such connectors having a contact for removably gripping a conductor with improved retention.

BACKGROUND OF THE INVENTION

Remote acoustical speakers used with various audio systems are typically interconnected with their audio system by means of multiple conductors. The conductors are releasably received in contacts in a connector that is attached to a respective one of each of the speakers. These connectors usually include openings through which the conductors are inserted and a button or lever that is depressed to open the contacts so that the conductor can be fully inserted. When the button or lever is released, a resilient member closes the contacts to make the desired electrical connections. These contacts, rely on the force of the resilient member to hold the contact closed so that the conductor is firmly held in place. However, many typical contacts have substantially straight gripping edges that tend to allow the conductor to slide out of the contact when the conductor is under a moderate amount of axially directed force. This is especially true for relatively large diameter conductors of the type that are commonly used in the consumer audio industry.

What is needed is a connector having contacts with gripping surfaces that are formed to extend partially around the outer diameter of the conductor and that bite into the surface to provide increased retention as well as better electrical contact.

SUMMARY OF THE INVENTION

An electrical connector associated with a component is arranged to releasably receive a conductor and electrically interconnect the conductor to the component. The connector includes an insulating housing, a contact member in a cavity within the housing, and a movable member. The contact member has a shank, a pair of first and second opposed beams extending from opposite edges of the shank, and a gripping portion spaced from the shank and movable to an open position for receiving the conductor therein and movable to a closed position for gripping and electrically contacting the conductor. The movable member is movably coupled to the housing and arranged to engage the contact member for selectively moving the gripping portion between the open and closed positions. The gripping portion includes first and second opposed grippers each having a thickness. The first gripper extends from the first beam toward the second beam and terminates in a first edge, and the second gripper extends from the second beam toward the first beam and terminates in a second edge. The first and second grippers are swaged to a reduced thickness at their respective first and second edges and cooperate to grip and electrically contact the conductor when in the closed position.

An embodiment of the invention will now be described by way of example with reference to the following drawings.

DESCRIPTION OF AN EMBODIMENT OF THE INVENTION

Figure 1:
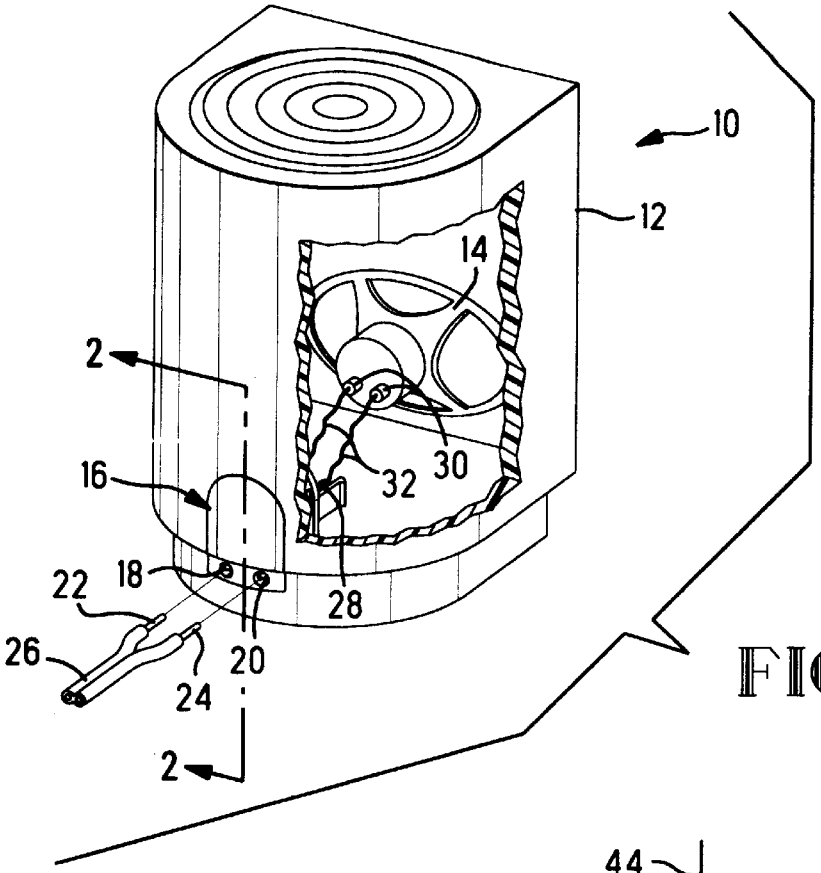
FIG. 1 is an isometric view of a component having an electrical connector incorporating the teachings of the present invention.

There is shown in FIG. 1 a speaker enclosure 10 having an outer housing 12 containing an acoustical speaker 14. An electrical connector 16 is arranged within an opening in the housing 12 and includes a pair of wire receiving openings 18 and 20 for receiving a pair of conductors 22 and 24 of a cable 26, one conductor in each respective opening. The connector 16 includes a pair of contact posts 28 which are interconnected to terminals 30 on the speaker 14 by means of wires 32, in the usual manner, for interconnecting each conductor 22, 24 to a respective one of the terminals 30.

Figure 2:
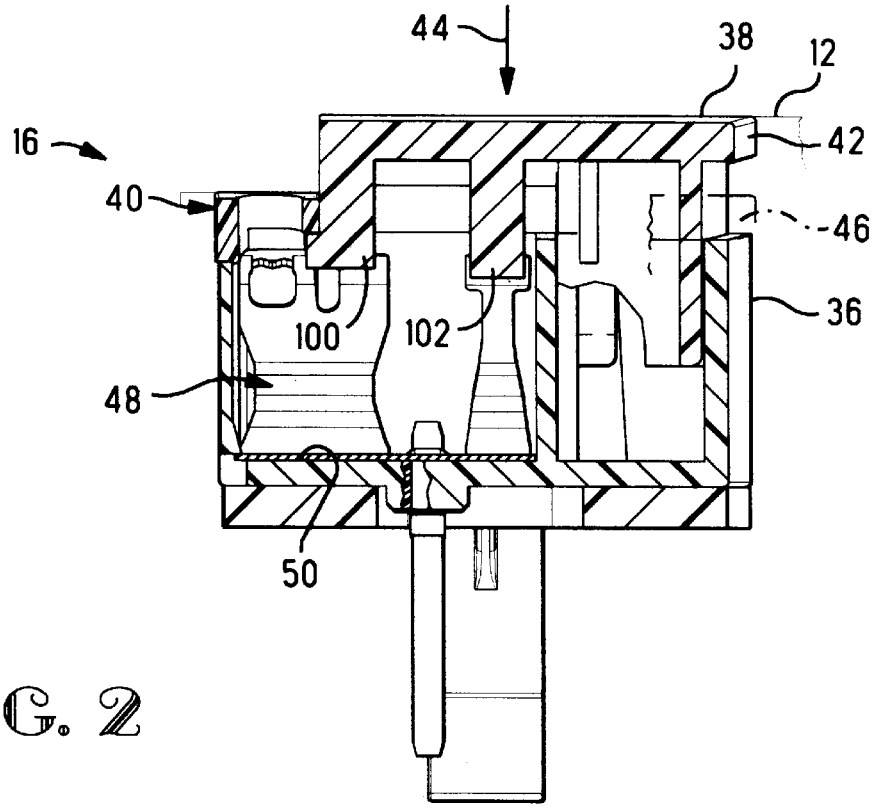
FIG. 2 is a cross-sectional view of the connector shown in FIG. 1.

The connector 16, as best seen in FIG. 2, includes an insulating housing 36, a depressiable push button 38, and a wire guide cap 40. The push button 38 can be depressed from a first position 42, shown in solid lines in FIG. 3, in the direction of the arrow 44 to a second position 46 shown in phantom lines. When pressure is released, the push button is returned to its first position 42, as will be described. The housing 36 includes two cavities, each of which snugly receives a respective one of first and second contact members 48 against a floor 50 of the cavity.

Figure 6:
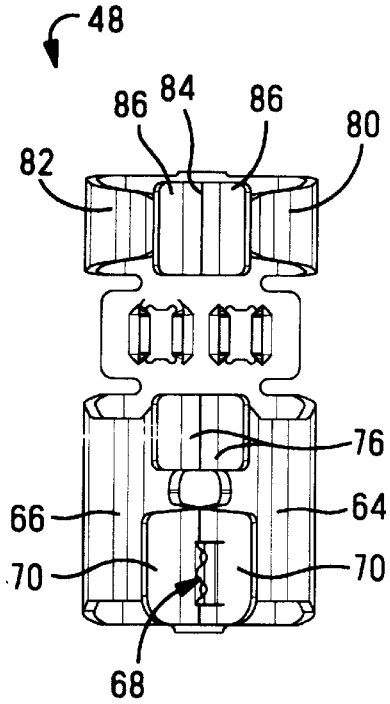
FIGS. 4, 5, and 6 are end, side, and plan views, respectively, of the contact shown in FIG. 3.
Figure 3:
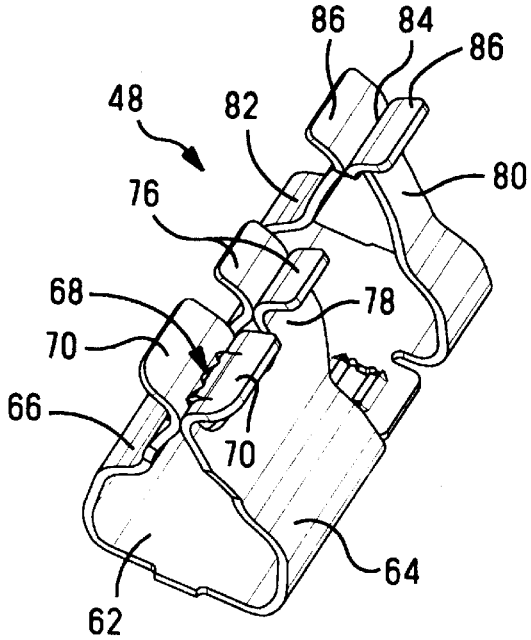
FIG. 3 is an isometric view of one of the contacts shown in FIG. 2.
Figure 4:
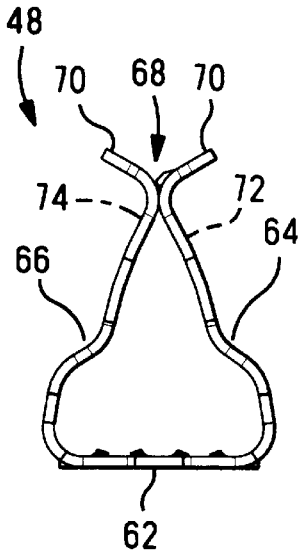
Figure 5:
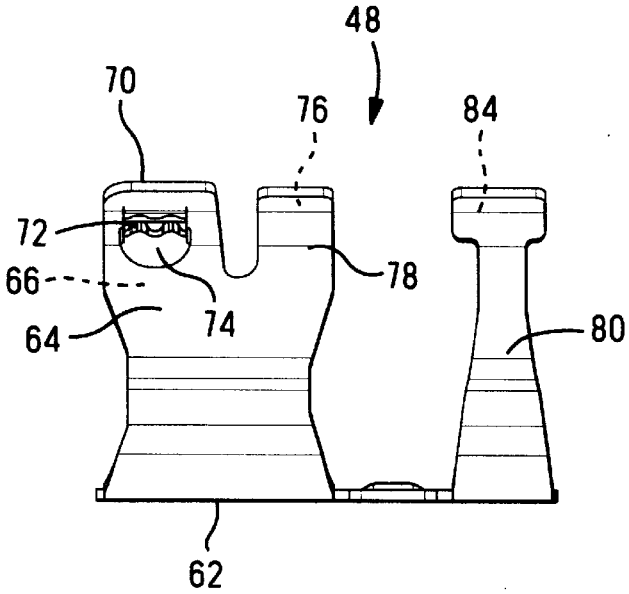

The first and second contact members 48 are identical and will be described with reference to FIGS. 3 through 7. Each contact member 48 includes a shank 62 and first and second opposed beams 64 and 66, respectively, extending from opposite sides of the shank. The two beams 64 and 66 curve upwardly from the shank 62, as viewed in FIG. 11, and then mutually converge to form a gripping portion where the two beams come into pressing engagement with each other at a gripping area 68 that is spaced vertically above the shank. The two beams 64 and 66 then mutually turn outwardly to form slightly V-shaped lead in flanges 70 for guiding the conductor 22, 24 into the gripping portion when it is inserted into the connector 16. A first opening 72, as best seen in FIG. 5, is formed through the first beam 64 and a second opening 74 is formed through the second beam 66. As is seen from the flat pattern view of the contact member shown in FIG. 7, the first and second openings 72 and 74 are substantially similar in size and shape. However, the first opening 72 is displaced further from the shank 62 than is the second opening 74 for a purpose that will be described. Each of the first and second beams 64 and 66 includes a first camming surface 76 formed on an extension 78 of the respective beam. The two first camming surfaces 76 are opposed and extend mutually outwardly to form an upwardly facing V-shape, as best seen in FIGS. 3 and 4, for a purpose that will be explained. The contact member 48 also includes third and fourth opposed beams 80 and 82, respectively, extending from opposite sides of the shank 62 and spaced from the first and second beams 64 and 66. The two beams 80 and 82 curve upwardly from the shank 62, similarly to the beams 64 and 66 as viewed in FIG. 4, and then mutually converge into near engagement with each other at a point of proximity 84, as best shown in FIGS. 3 and 6, spaced vertically above the shank. The two beams 80 and 82 may or may not actually touch at the point of proximity. The two beams 80 and 82 then mutually turn outwardly to form a pair of second camming surfaces 86. The two second camming surfaces 86 are opposed and extend mutually outwardly to form an upwardly facing V-shape, as best seen in FIG. 3, for a purpose that will be explained. The gripping area 68 includes a first gripping portion 90 formed in the flange 70 of the first beam 64 and a second gripping portion 92 formed in the flange 70 of the second beam 66. The structure and operation of the first and second gripping portions 90 and 92 will be described in detail below, but first, the general operation of the connector 16 will be described.

The push button 38, as best seen in FIG. 2, includes a pair of downwardly facing first wedged-shaped members 100 extending from the bottom side of the push button. Each of the wedge-shaped members 100 includes a pair of widely angled camming surfaces which terminate outwardly in an apex. The member 100 is positioned vertically above a portion of the junction of the lead-in flanges 70 and the junction of the two first camming surfaces 76. When the push button 38 is depressed to move it from its first position 42 to its second position 46, the two first wedge-shaped members 100 engage their respective first camming surfaces 76, causing them to separate so that the first and second beams 64 and 66 of each contact elastically deflect away from each other. This causes a space to form at the gripping area 68 between the first and second gripping portions 90 and 92. The camming surfaces of the first wedge-shaped members 100 are widely angled so that the space formed at the gripping area 68 is sufficient to receive 12 gage wire. This gives the connector 16 a useful range of sizes for the conductors 22 and 24 of between about 18 gage to about 12 gage. Each of the contact members 48 can accommodate any size conductor within the range independent of the size conductor in the other contact member. A pair of second wedge-shaped members 102 extend downwardly from the bottom of the push button 36. Each second wedge-shaped member 102 is positioned vertically over the point of proximity 84 of a respective one contact 48. Each of the second wedge-shaped members includes a pair of opposite angled camming surfaces which terminate outwardly in an apex. When the push button is depressed, as described above, each of the wedge-shaped members 102 engages the two second camming surfaces 86 of its respective contact, causing the third and fourth beams 80 and 82 to elastically deflect away from each other, thereby storing energy in the beams to provide a return force. When the push button 38 is released, it is urged upwardly again to its first position 42 by means of the stored energy in the third and fourth beams, the second camming surfaces 86 pushing against the two second wedge-shaped members 102. Note that this return force is supplied by the third and fourth beams independent of the first and second beams and whether or not a conductor is present within the gripping area 68.

Figure 7:
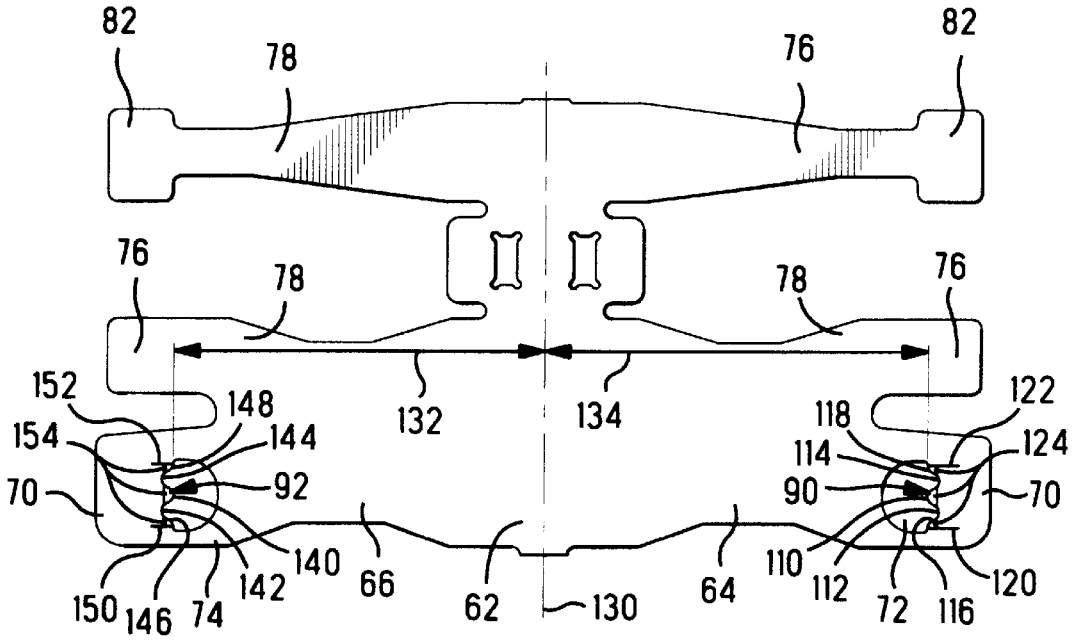
FIG. 7 is a flat pattern view of the contact shown in FIG. 3.
Figure 7A:
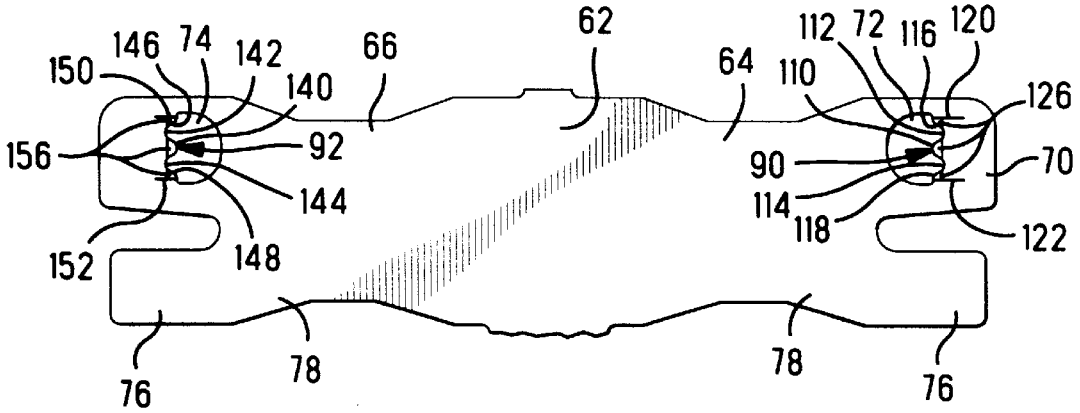
FIG. 7A is a bottom view of a portion of the flat pattern view shown in FIG. 7.

The first gripping portion 90, as best seen in FIGS. 7 and 7A, includes a central radiussed portion 110 extending into the opening 72 having radiussed cutouts 112 and 114 on opposite sides thereof that extend into the flange 70. The outer portions of the cutouts 112 and 114 form radiussed projections 116 and 118 that extend into the opening 72 and terminate in slits 120 and 122. A first upper swaged area 124, shown in FIGS. 7 and 9, and a first lower swaged area 126, shown in FIGS. 7A and 9, cause the outer surfaces of the first gripping portion 90 to converge toward the first opening 72 and terminate at a first edge so that the thickness at the edge has diminished to about one third its original thickness. The important purpose of this, as will be explained, is to provide edges that will bite into the conductors 22 and 24 and aid in their retention within the mating gripping portions 90 and 92. As shown in the flat pattern views of FIGS. 7 and 7A, the second gripping portion 92 is similar in structure and shape to the first gripping portion 90 except that it is positioned closer to the center 130 of the shank 62 than is the first gripping portion. That is, the distance 132, shown in FIG. 7, is smaller than is the distance 134. The second gripping portion 92, as best seen in FIGS. 7 and 7A, includes a central radiussed portion 140 extending into the opening 74 having radiussed cutouts 142 and 144 on opposite sides thereof that extend into the flange 70. The outer portions of the cutouts 142 and 144 form radiussed projections 146 and 148 that extend into the opening 72 and terminate in slits 150 and 152. A second upper swaged area 154, shown in FIGS. 7 and 10, and a second lower swaged area 156, shown in FIGS. 7A and 10, cause the outer surfaces of the second gripping portion 92 to converge toward the second opening 74 and terminate at a second edge so that the thickness at the edge has diminished to about one third its original thickness.

Figure 8:
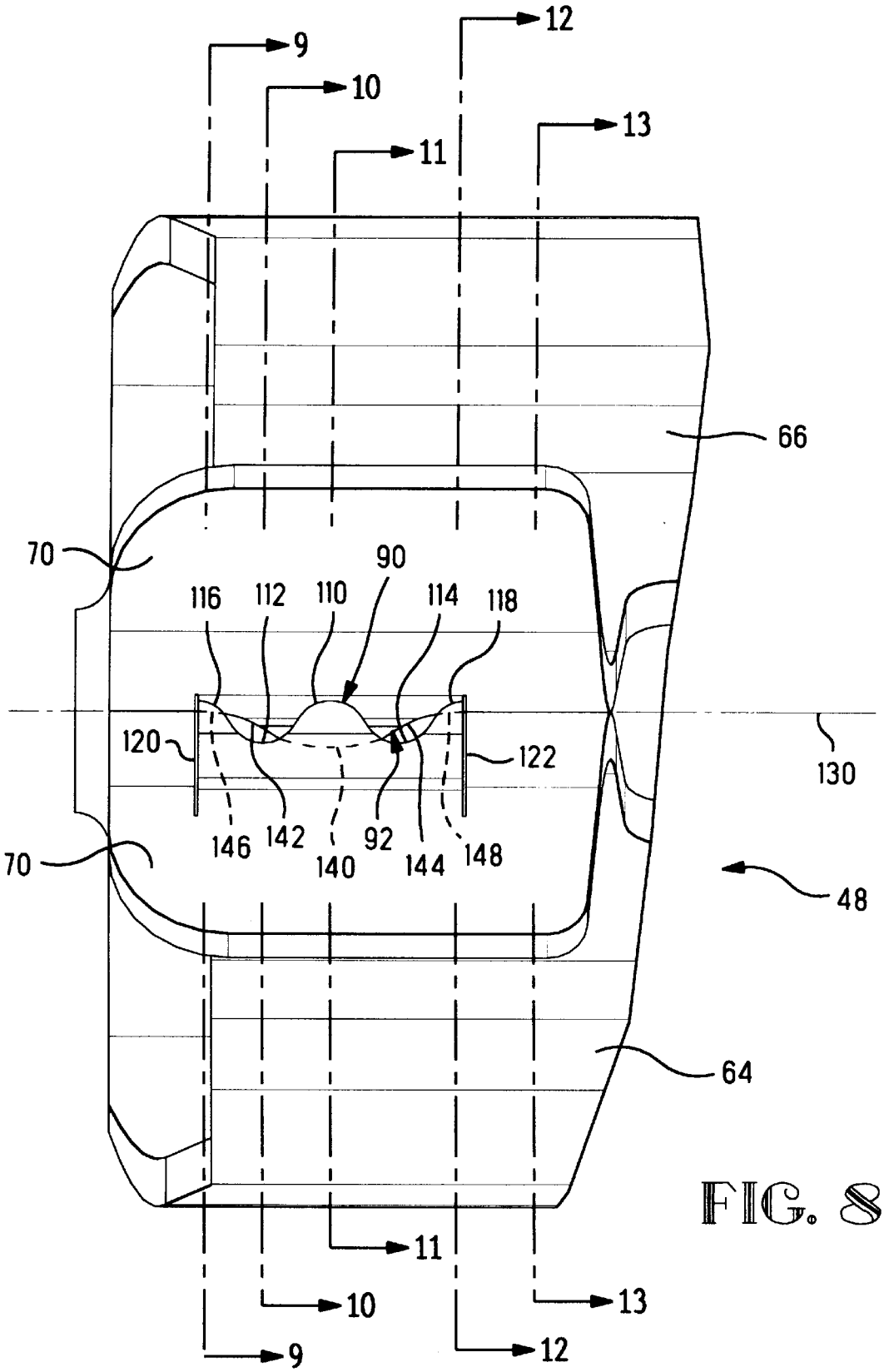
FIG. 8 is an enlarged view of a portion of the contact shown in FIG. 6.
Figure 9:
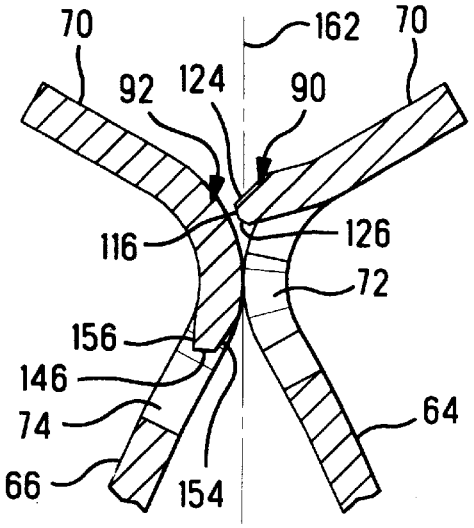
FIGS. 9, 10, 11, 12, and 13 are partial cross-sectional views taken along the lines 9—9, 10—10, 11—11, 12—12, and 13—13, respectively, in FIG. 8.
Figure 10:
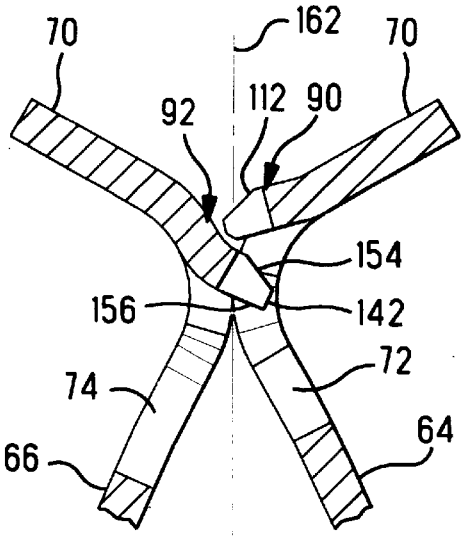
Figure 11:
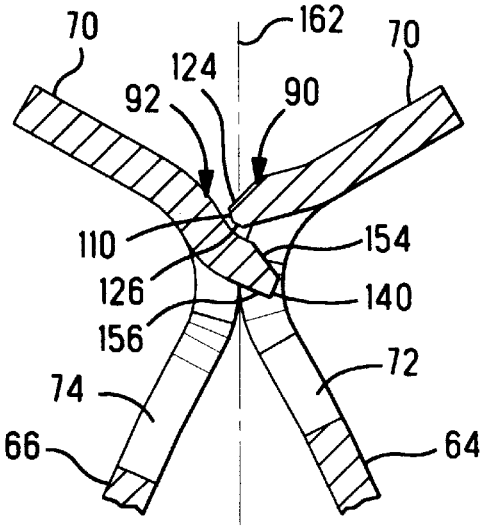
Figure 12:
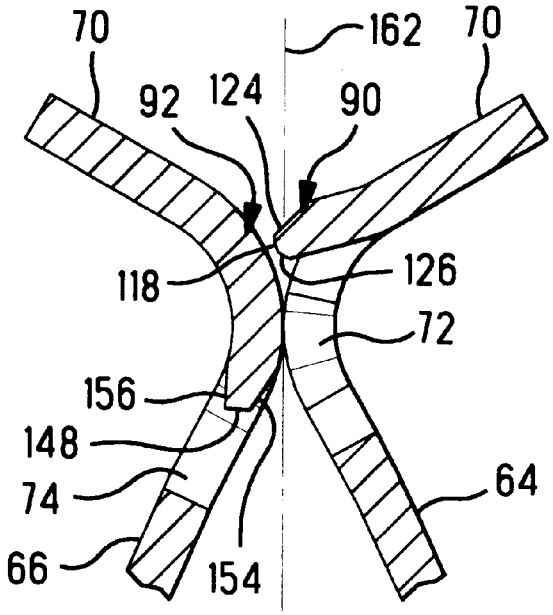
Figure 13:
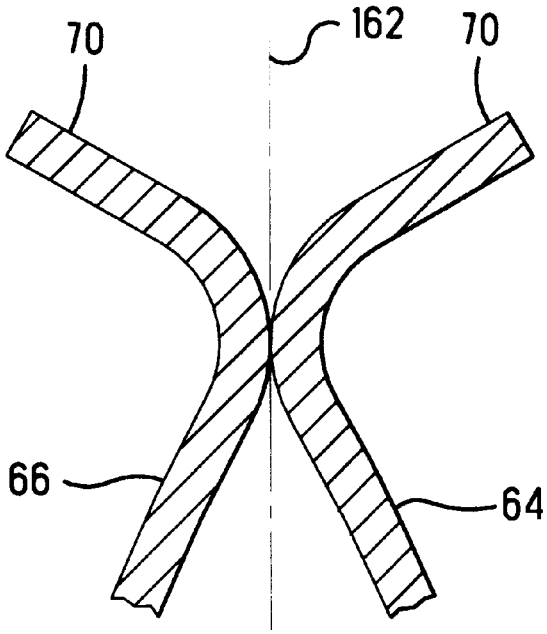

During the forming of the contact member 48, the first and second gripping portions 90 and 92 are deformed out of the plane of the material to take the shapes that are shown in FIGS. 9 through 13. These shapes will now be described with reference to these FIG., which are cross-sectional views taken from FIG. 8. As shown in FIG. 13, the radiussed portions of the first and second beams 64 and 66 are in mutual pressing engagement along a vertical centerline 162 which intersects the center 130 of the shank 62. As shown in FIGS. 9 and 12, the radiussed projections 146 and 148 of the second gripping portion 92 are displaced out of the plane of the second beam 66 toward but not past the center line 162. The radiussed projections 116 and 118 of the first gripping portion 90, on the other hand, are also displaced out of the plane of the first beam 64 and extend well past the centerline 162 and vertically overlap a portion of the second gripping portion. As best seen in FIG. 10, the central radiussed portion 140 of the second gripping portion 92 is displaced further toward the center line 162 and extends beyond it and into the opening 72 a short distance. The second upper and lower swaged areas 154 and 156 are more pronounced at this point than at the radiussed projections 146 and 148, as shown in FIG. 9. As shown in FIG. 11, the central radiussed portion 140 extends further passed the centerline 162 and further into the opening 72 than the radiussed cutout 142 shown in FIG. 10. Also the central radiussed portion 110 of the first gripping portion 90 extends toward and beyond the centerline 162 in a manner similar to the radiussed projections 116 and 118 shown in FIGS. 9 and 12. Note that, at this point both the first and second gripping portion extend toward and past the centerline 162 so that the first gripping portion 90 overlaps the second gripping portion 92 on the side of the second beam 66 and the second gripping portion 92 underlaps the first gripping portion 90 on the side of the first beam 64.

Figure 14:
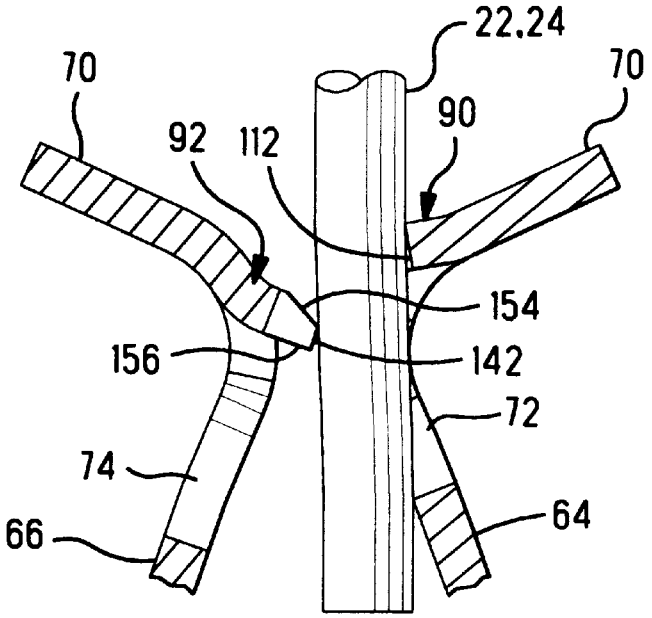
FIG. 14 is a view similar to that of FIG. 10 showing a conductor in gripping position.
Figure 15:
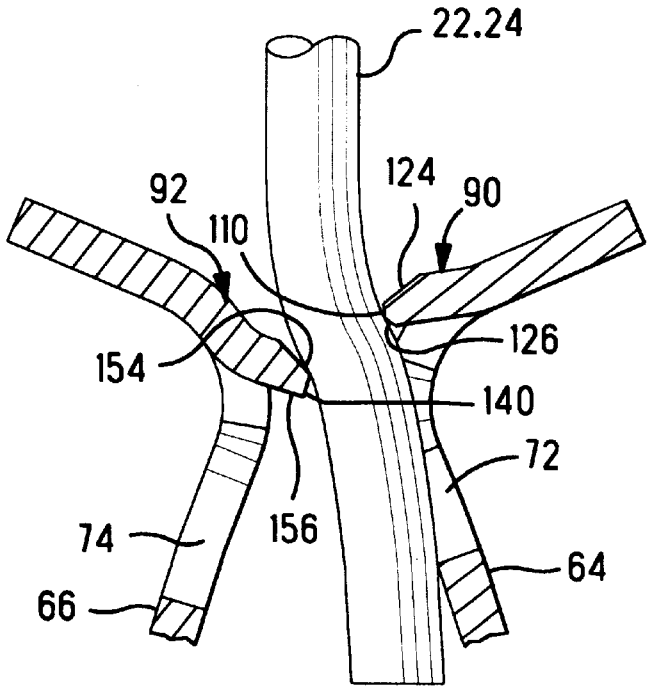
FIG. 15 is a view similar to that of FIG. 11 showing a conductor in gripping position.

FIGS. 14 and 15 are cross-sectional views similar to those of FIGS. 10 and 11, respectively, showing a typical conductor 22,24 in gripped position. In FIG. 14, the edge of the radiussed cutout 142 forces the conductor 22,24 into the opening 72 and into tight engagement with the edge of the radiussed cutout 112, the corners of both the radiussed cutouts 142 and 112 biting into the conductor to aid in retaining the conductor in gripping position. In certain cases the conductor 22,24, especially a large diameter conductor, will seat between the two central radiussed portions 110 and 140, as shown in FIG. 15. There the central radiussed portion 140 forces the conductor into the opening 72 and into tight engagement with central radiussed portion 110 so that the corners of the central radiussed portions bite into the conductor thereby retaining it in gripping position. The first and second gripping portions 90 and 92, as shown in FIGS. 9 through 15 are substantially angled toward the center line 162 and downwardly toward the shank 62. This tends to cause the gripping portions to more strongly grip the conductor 22,24 when the conductor is urged in a direction away from the contact member 48, That is, the two gripping portions and their respective flanges 70 tend to pivot slightly upwardly thereby causing the first and second beams to deflect outwardly which increases the force tending to urge the beams toward the centerline 162. This slight pivoting tendency provides a greater conductor retaining force than would otherwise be available due only to the normal forces provided by the first and second beams 64 and 66.

While the connector 16 is described herein with respect to interconnecting remote acoustical speakers with various audio systems, it will be understood that the connector 16 can be advantageously utilized to electrically attach conductors to other electrical components and equipment, and that such use is considered to be within the spirit and scope of the claims appended hereto. Further, it will be understood that the connector 16 can have a single contact member 48 for accommodating a single conductor or more than two contact members 48 for accommodating more than two conductors 22 and 24.

An important advantage of the present invention is that the gripping surfaces of the contact members are formed to bite into the surface of the conductor to provide increased retention as well as better electrical contact. Further, the flanges containing the gripping surfaces tend to pivot slightly when the conductor is urged in a direction away from the contact member thereby increasing the retention force.

We claim:

1. An electrical connector associated with a component for releasably receiving a conductor and electrically interconnecting said conductor to said component comprising:

(1) an insulating housing;

(2) a contact member in a cavity within said housing having a shank, a pair of first and second opposed beams extending from opposite edges of said shank, and a gripping portion spaced from said shank and movable from a closed position to an open position for receiving said conductor therein and movable from said open to said closed position for gripping and electrically contacting said conductor; and (3) a movable member movably coupled to said housing and arranged to engage said contact member at a location spaced from said gripping portion thereof for selectively moving said gripping portion between said open and closed positions, wherein said gripping portion comprises first and second opposed grippers each having a thickness, said first gripper extending from said first beam toward said second beam and terminating in a first edge, and said second gripper extending from said second beam toward said first beam and terminating in a second edge, said first and second grippers being swaged to a reduced thickness at their respective first and second edges such that upon inserting a conductor into said gripping portion while in said open position, said first and second grippers cooperate to grip and electrically contact said conductor when said gripping portion is moved to said closed position.

2. The connector according to claim 1 wherein said first edge is further from said shank than is said second edge.

3. The connector according to claim 1 wherein said first and second grippers are angled to converge toward said shank in a direction toward their respective first and second edges.

4. The connector according to claim 1 wherein said first and second edges overlap when said gripping portion is in said closed position without a said conductor received therein.

5. The connector according to claim 4 wherein said first edge is swaged on a side away from said second edge.

6. The connector according to claim 5 wherein said second edge is swaged on a side toward said first edge.

7. The connector according to claim 5 wherein said second edge is swaged on a side away from said first edge.

8. The connector according to claim 5 wherein one of said first and second edges is swaged on both sides.

9. The connector according to claim 1 including an axis perpendicular to said shank and extending between said first and second beams so that said first beam is on a first side of said axis and said second beam is on a second side of said axis, wherein a portion of said first edge extends over said axis to said second side.

10. The connector according to claim 9 wherein a portion of said second edge extends over said axis to said first side.

11. The connector according to claim 1 wherein said contact member includes a pair of opposed camming surfaces, each first camming surface attached to a corresponding one of said first and second beams, and wherein said movable member includes a cam attached thereto for engaging said opposed camming surfaces and thereby moving said contact to said open position.

12. The connector according to claim 11 wherein said cam is wedge-shaped having a pair of angled surfaces.

* * * * *